US007251921B2

(12) United States Patent
Galimberti et al.

(10) Patent No.: US 7,251,921 B2
(45) Date of Patent: Aug. 7, 2007

(54) CAPPING UNIT FOR CLOSING CONTAINERS WITH RESPECTIVE CAPS

(75) Inventors: Enrico Galimberti, Porto Mantovano (IT); Stefano Cavallari, Bologna (IT)

(73) Assignee: Azionaria Construzioni Macchine Automatiche A.C.M.A. S.p.A., Bologna (IT)

( * ) Notice: Subject to any disclaimer, the term of this patent is extended or adjusted under 35 U.S.C. 154(b) by 16 days.

(21) Appl. No.: 10/564,776

(22) PCT Filed: Jul. 15, 2004

(86) PCT No.: PCT/IB2004/002330

§ 371 (c)(1),
(2), (4) Date: Jan. 17, 2006

(87) PCT Pub. No.: WO2005/007556

PCT Pub. Date: Jan. 27, 2005

(65) Prior Publication Data

US 2006/0272284 A1 Dec. 7, 2006

(30) Foreign Application Priority Data

Jul. 17, 2003 (IT) ..... BO2003A0432

(51) Int. Cl.
*B67B 3/20* (2006.01)
*B67B 3/26* (2006.01)

(52) U.S. Cl. ..... 53/317; 53/52; 53/331.5

(58) Field of Classification Search ..... 53/52, 53/75, 317, 331, 331.5, 306, 307, 308
See application file for complete search history.

(56) References Cited

U.S. PATENT DOCUMENTS 1,997,351 A * 4/1935 Tevander ..... 53/307
2,026,118 A * 12/1935 Barnby ..... 53/331.5
4,265,071 A * 5/1981 Smith et al. ..... 53/331.5
4,299,072 A 11/1981 Holstein
4,535,583 A 8/1985 Tanaka et al.
4,616,466 A * 10/1986 Tanaka et al. ..... 53/317
5,400,564 A * 3/1995 Humphries et al. ..... 53/317
5,419,094 A * 5/1995 Vander Bush et al. ..... 53/317
6,105,343 A * 8/2000 Grove et al. ..... 53/317
6,158,196 A * 12/2000 Trebbi et al. ..... 53/331.5

FOREIGN PATENT DOCUMENTS

DE 20218523 3/2003
EP 0863106 9/1998

* cited by examiner

*Primary Examiner*—Louis Huynh
(74) *Attorney, Agent, or Firm*—Timothy J. Klima

(57) ABSTRACT

Containers (2) are closed with screw caps (3) by a unit (1) of the type comprising a carousel (7) on which to advance the containers (2) and the relative caps (3), driven by a motor (6) about a respective primary axis (5*a*) and equipped with a plurality of capping assemblies (11) each positioned above a relative container (2) and capable of movement vertically between a first position, distanced from the container (2), and a second position of active engagement with the container (2). Each capping assembly (11) presents a gripping mechanism (17) positionable so as to engage a relative cap (3) when the assembly (11) is in the second position, and rotatable about a respective secondary axis (17*a*) in such a way as to screw the cap (3) onto a threaded neck (4) of the relative container (2). The unit (1) further comprises first motors (14) by which the capping assemblies (11) can be raised and lowered one independently of another, and second motors (18) by which the gripping mechanisms (17) can be rotated one independently of another.

16 Claims, 6 Drawing Sheets

CAPPING UNIT FOR CLOSING CONTAINERS WITH RESPECTIVE CAPS

This application claims priority to Italian Patent application number BO2003A00432, filed Jul. 17, 2003, which is incorporated by reference herein.

This application is the National Phase of International Application PCT/IB2004/002330 filed Jul. 15, 2005 which designated the U.S. and that International Application was published under PCT Article 21(2) in English.

TECHNICAL FIELD

The present invention relates to a capping unit for closing containers with respective caps.

In particular, the invention finds application in systems for filling containers designed to hold substances and/or products consisting in liquids, viscous fluids, creams, gels and/or powders.

BACKGROUND ART

The prior art embraces capping units such as will apply caps automatically to respective containers, consisting generally in a plurality of capping assemblies set in motion on a carousel rotatable about a vertical axis.

By way of example, European Patent EP 0636573 owned by the present applicant discloses a unit in which each capping assembly is set in rotation, about a respective axis parallel to the axis of rotation of the carousel, by a respective shaft capable of axial movement relative to the carousel in such a way that the assembly can be shifted toward and away from a relative container revolving on the carousel.

Each capping assembly is equipped with a relative mechanism such as a gripper, by means of which the cap is clasped and screwed onto the threaded neck of a respective container by inducing a rotation of the aforementioned shaft.

The carousel consists substantially in a frame carrying a vertical main drum and a platform at the top of the drum. The frame also serves to support the containers, each aligned beneath a respective capping assembly.

The shafts of the single capping assemblies are carried by a housing associated with the top platform and equipped internally with a stationary drum cam surmounting the main drum of the carousel.

The drum cam presents a side wall affording annular groove cam profiles, such as will accommodate following rollers connected to the shafts of the single capping assemblies and able thus to bring about their vertical movement, also a ring gear integral with the outer surface presented by the side wall of the drum cam. Each of the shafts supporting a capping assembly carries a pinion in mesh with the ring gear of the drum cam.

Thus, when the drum is set in motion around the axis of rotation, the interaction of each pinion with the fixed ring gear of the drum cam will cause the capping assembly to rotate about its own axis. The vertical and rotational movement transmitted to the shafts of the capping assemblies and the movement of the associated grippers are all synchronized in such a manner that successive caps can be taken up by the grippers and screwed onto the respective containers.

The cap is screwed onto the container applying a predetermined tightening torque beyond which a torque limiting device, for example an adjustable clutch associated with each assembly, will begin to slip and thus allow the grippers to lock and terminate the step of screwing the cap onto the neck.

Capping units of the type outlined above are effective, but affected nonetheless by significant drawbacks.

In reality, whilst the aforementioned capping units are able to effect a secure closure of the cap on the container, the applicant finds that there are certain shortcomings as regards the versatility of such units, in terms of the extent to which they can be used with containers of different sizes.

More exactly, it will be appreciated that the vertical travel of each capping assembly depends on the profile of the groove afforded by the drum cam, which positions each capping assembly at a given height, enabling the gripper to engage the cap.

This means that if containers of different height are fed onto the carousel, the drum cam cannot be used as it will no longer be possible to position the gripper at the height of the new container. Generally speaking, the capping unit will utilize a carousel adapted to the size of a given container, with a cam profile allowing the gripper to be positioned at the correct height.

Consequently, the production line must be equipped with a number of units, each dedicated to a certain size of container, generating an increase in costs and a requirement for additional space in which to accommodate the various distinct units.

Another drawback stems from the construction costs and the overall dimensions of the single dedicated capping units.

This drawback is attributable to the use of mechanical components by which each of the individual capping assemblies is set in rotation; besides being bulky and cumbersome, the components in question are particularly costly and require frequent maintenance.

In effect, the mechanical components in question are precision-engineered parts calling for particular care in assembly, in order to ensure that each cap will be closed accurately on the container. A case in point is the adjustable clutch, for example, which not only must be set up for each production run according to the type of container and cap, but is also made to extremely high specifications and thus notably expensive.

The object of the present invention is to overcome the problems associated with the prior art by providing a capping unit for closing containers with respective caps, such as will be versatile and suitable for use with any type of container, irrespective of size.

In particular, one important object of the present invention is to set forth a capping unit such as will be adaptable easily to any type of container used in production, regardless of the dimensions.

A further object of the present invention is to provide a particularly economic and compact capping unit, though without losing the functional advantages typical of the prior art.

DISCLOSURE OF THE INVENTION

These objects and others besides, which will emerge more clearly from the following specification, are substantially realized in a capping unit according to the present invention.

The invention will now be described in detail, by way of example, with the aid of the accompanying drawings, in which.

Figure 1:
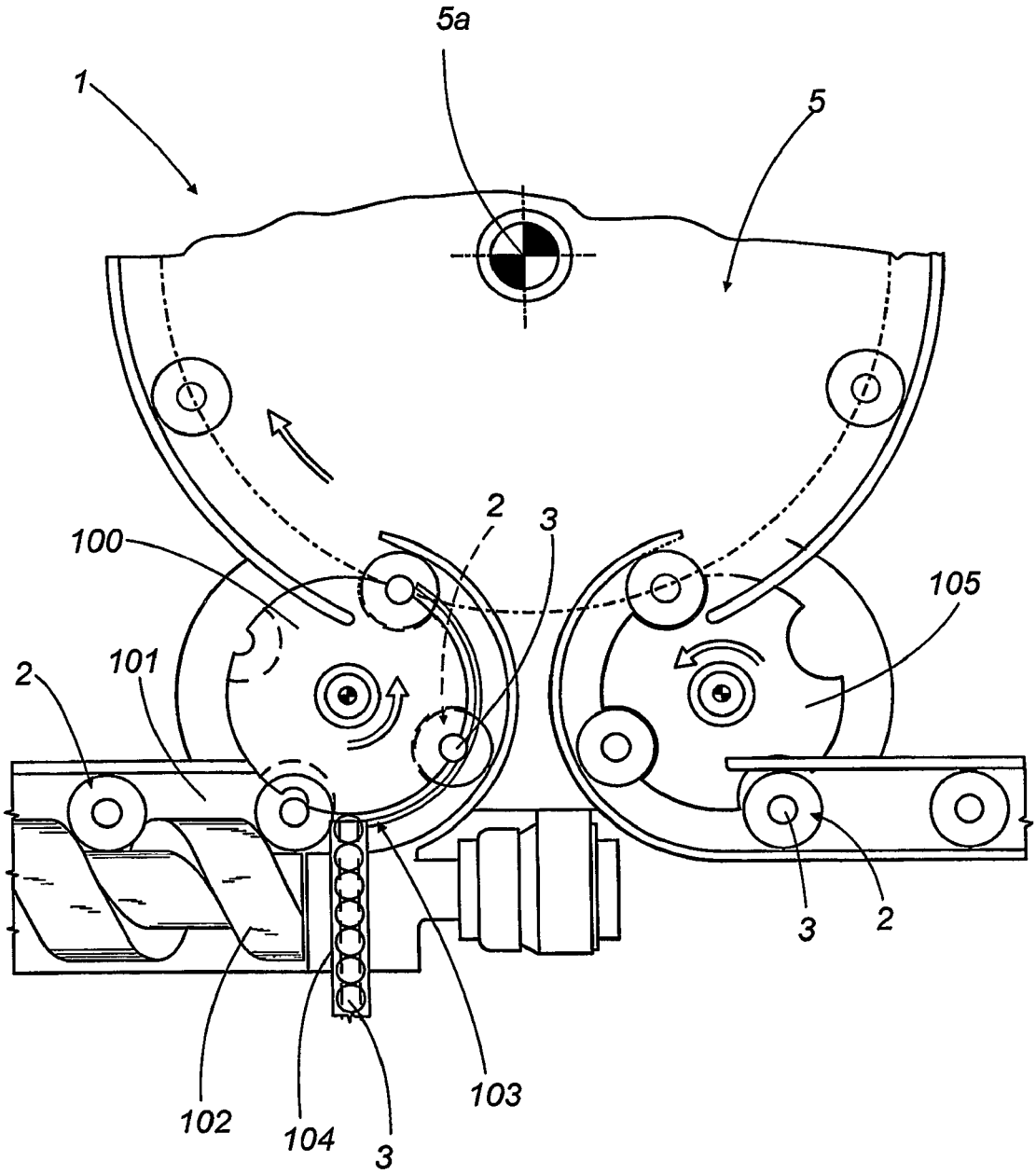
FIG. 1 is a schematic plan view of the capping unit according to the present invention, installed on a container-filling production line.

Referring to the accompanying drawings, 1 denotes a capping unit according to the invention, in its entirety, for closing containers 2 with respective caps 3.

Each container 2 comprises a body presenting an externally threaded neck 4, and a cap 3 threaded internally in its turn and attachable thus releasably to the neck 4 of the body. The containers 2 can be of any given type, such as flacons or bottles, or even cartons fashioned of paper material and furnished with a welded neck closed by a respective plastic cap.

With reference to FIG. 1, which shows the capping unit 1 installed in a production line, the unit 1 comprises a carrier and conveyor component 5 mounted in such a way as to rotate clockwise, as seen in FIG. 1, about a vertical primary axis 5*a*. The carrier component 5 receives a succession of containers 2 and a separate succession of caps 3 from a rotary infeed conveyor 100 operating at a first transfer station.

The infeed conveyor 100 is set in rotation, turning anticlockwise as seen in FIG. 1 about an axis parallel to the primary axis 5*a*, and in receipt of a succession of containers 2 taken up at a first infeed station 101 from a horizontal duct equipped with a screw feeder 102 by which the containers are directed at regular intervals into the station 101.

Also directed onto the infeed conveyor 100, at a second infeed station 103, is a succession of caps 3 entering along a horizontal duct 104 extending perpendicular to the screw feeder 102.

The carrier component 5 is disposed and configured in such a way as to effect the assembly of the caps 3 with the relative containers 2 and to direct each container 2 fitted with a relative cap 3 onto a rotary outfeed conveyor 105 by way of a second transfer station 106.

Figure 2:
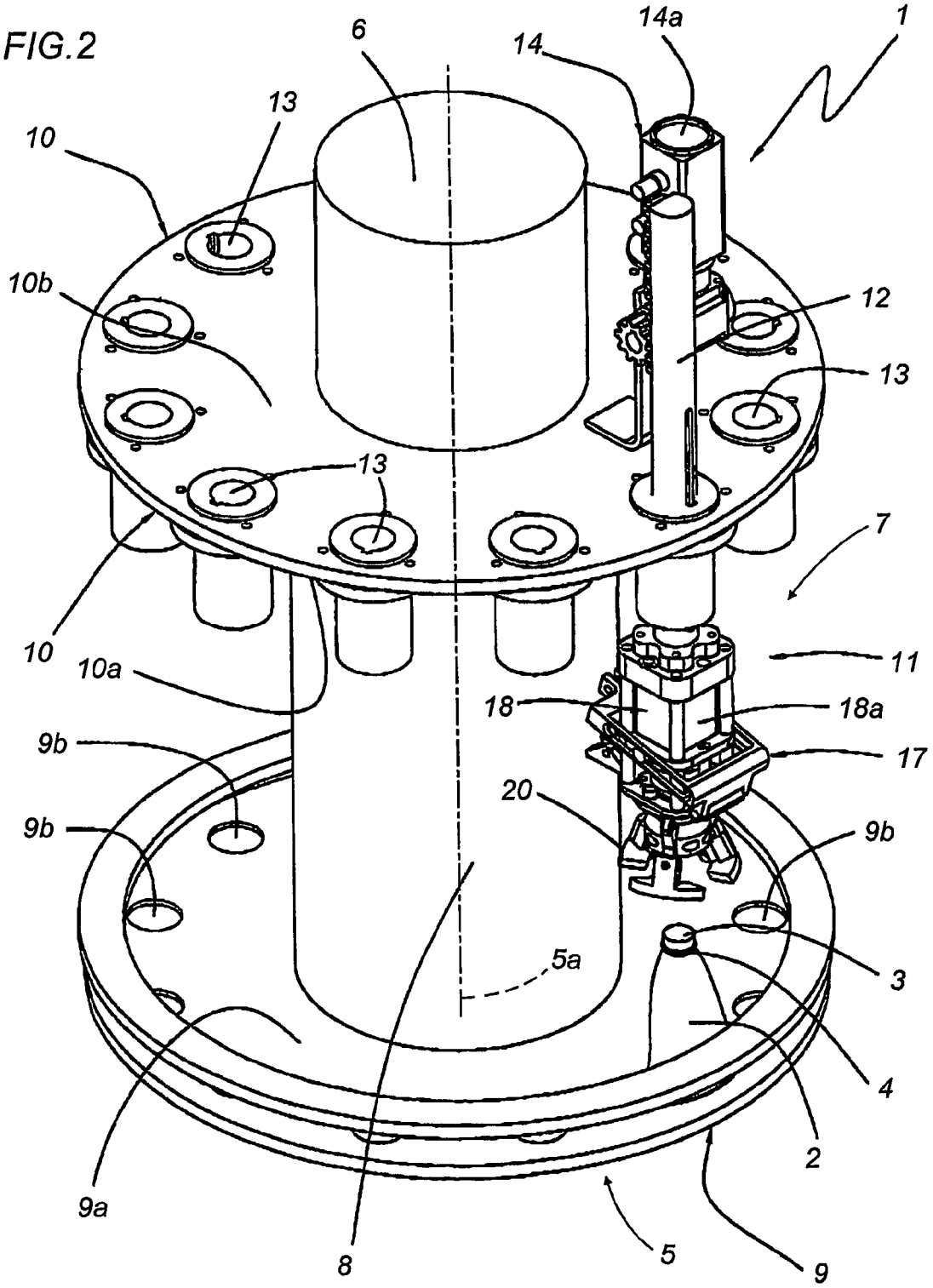
FIG. 2 shows the capping unit in perspective, with certain parts omitted better to reveal others.

As discernible to better advantage in FIG. 2, the component 5 carrying and conveying the containers 2 is set in motion by a respective motor 6 of familiar in embodiment, illustrated schematically in the drawing.

More exactly, the carrier component 5 is embodied as a carousel 7 presenting a drum 8 of cylindrical geometry associated with the aforementioned motor 6 and rotatable thus about the primary axis 5*a*.

Also forming part of the carousel 7 is a base 9, located below the drum 8, on which the containers 2 are supported as they advance ordered in single file each with the relative neck 4 directed upwards.

More precisely, the base 9 is of substantially circular appearance and presents an annular carrying surface 9*a* disposed transversely to the longitudinal dimension of the drum 8 and directed toward the selfsame drum. The peripheral edge of the annular surface 9*a* presents a plurality of seats 9*b*, each designed to accommodate a respective container 2 and hold it in a vertical position.

The carousel 7 further comprises a platform 10 associated with the top of the drum 8 and positioned facing the base 9.

In a preferred embodiment, the platform 10 likewise will be of circular appearance, presenting a first annular surface 10*a* disposed parallel with and facing the base 9, and a second annular surface 10*b* facing in the opposite direction to the first surface 10*a*.

The capping unit 1 also includes a plurality of capping assemblies 11 associated with the carrier component 5, each positioned above a corresponding container 2. Each capping assembly 11 is capable of vertical movement in a manner that will be made clear in due course, between a first position, distanced from the respective container 2, and a second position actively engaging the container 2.

Notwithstanding FIG. 2 shows just one capping assembly 11 associated with the carrier component 5, for the sake of clarity, the capping assemblies 11 will advantageously be equal in number to the containers 2 standing on the base 9 and distributed around the full peripheral length of the platform 10.

In greater detail, each capping assembly 11 presents a rod 12 accommodated slidably within a guide 13 afforded by the platform 10.

The rod 12 extends longitudinally parallel to the primary axis 5*a* of the unit 1 and presents a bottom first end 12*a* located between the first surface 10*a* of the platform 10 and the annular surface 9*a* of the base 9, also a top second end 12*b*, opposite from the first end 12*a*, located above the second surface 10*b* of the platform 10.

The second ends 12*b* of the rods 12 are associated with first drive means 14 by which the single capping assemblies 11 can be set in motion vertically, one independently of another.

To advantage, such first drive means 14 include a plurality of primary electric motors 14*a* each associated with a respective rod 12.

In particular, each primary electric motor 14*a* is associated with the second end 12*b* of the respective rod 12 and positioned above the second surface 10*b* of the platform 10.

Figure 3:
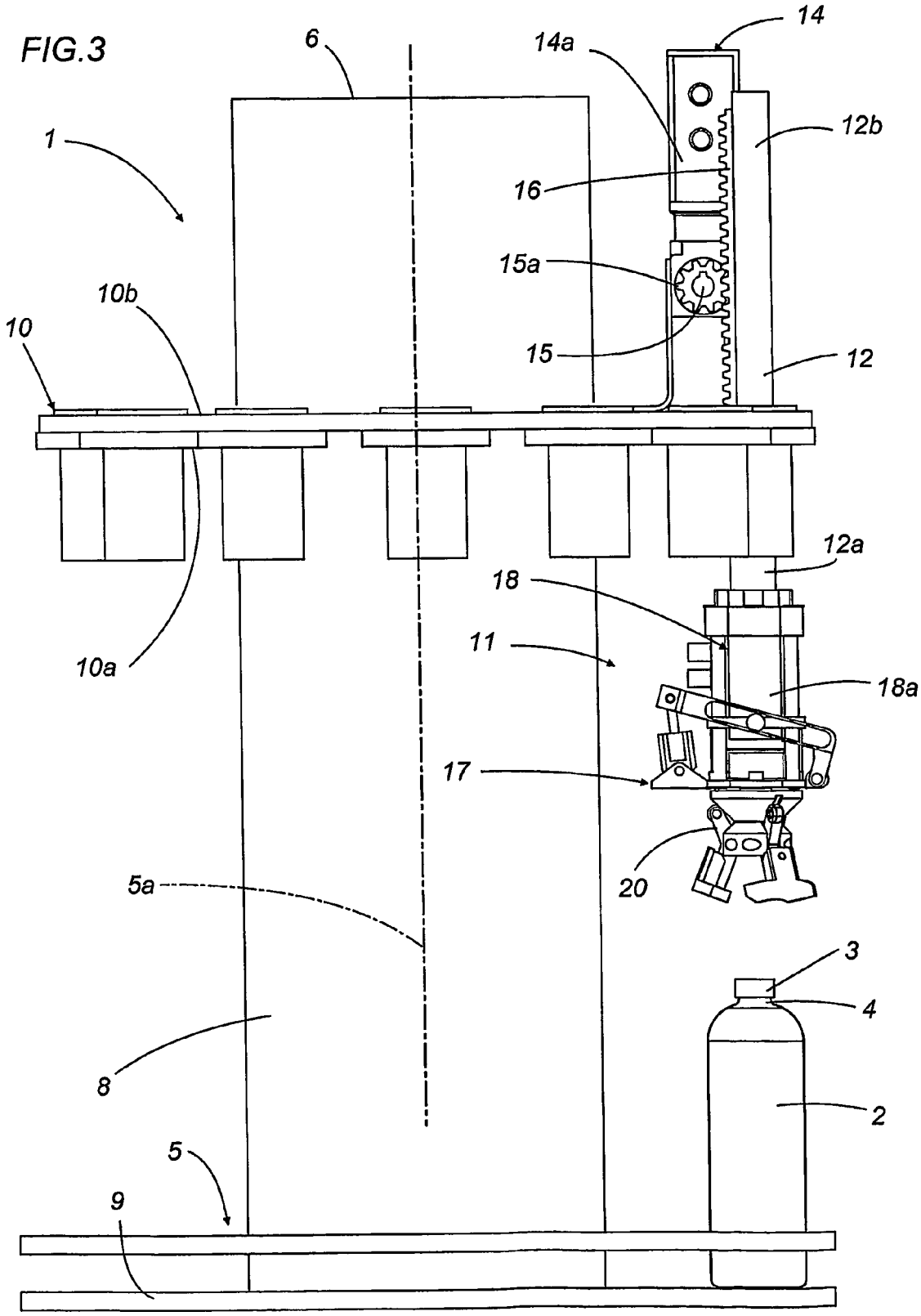
FIG. 3 is an elevation view of the capping unit shown in FIG. 2.

Still more particularly, and as better illustrated in FIG. 3, the primary electric motor 14*a* presents a shaft 15 rotatable about an axis extending normal to the primary axis 5*a*, and a gear 15*a* keyed to this same shaft 15.

Positioned thus, the gear 15*a* is able to engage in mesh with a rack 16 offered laterally by the second end 12*b* of the rod 12.

To advantage, setting the gear 15*a* in rotation will cause the rod 12 to shift vertically toward and away from the container 2.

Also associated with each capping assembly 11 is a gripping mechanism 17 designed to engage a respective cap 3 when the selfsame assembly 11 occupies the second position. The gripping mechanism 17 is rotatable about a respective secondary axis 17*a* parallel to the primary axis 5*a*, as will be explained shortly in more detail, in such a way as to screw the cap 3 onto the threaded neck 4 of the respective container 2.

More exactly, the single gripping mechanism 17 is associated with the first end 12*a* of the rod 12 and coupled to second drive means, denoted 18, by which it can be set in rotation independently of other gripping mechanisms 17.

In effect, the second drive means 18 include a plurality of secondary electric motors 18*a*, each associated with a respective gripping mechanism 17.

In particular, each secondary electric motor 18*a* is coupled between the first end 12*a* of the respective rod 12 and the gripping mechanism 17, and presents a shaft 19 aligned coaxially with the rod 12 and rotatable about the respective secondary axis 17*a*.

Accordingly, the gripping mechanism 17 can be set in rotation by activating the secondary electric motor 18*a* to turn the relative shaft 19

Still more particularly, the gripping mechanism 17 presents a gripper 20 attached to the shaft 19 of the relative secondary electric motor 18*a* and capable of movement between an open condition (FIG. 4), in which the corresponding capping assembly 11 is in the first position, and a closed condition (FIG. 5) in which the corresponding capping assembly 11 is in the second position and the gripper itself engages the relative cap 3. For the sake of clarity, the cap 3 is not shown in FIGS. 4 and 5.

The gripper 20 presents a carrier element 21 of substantially cylindrical appearance, associated in coaxial alignment with the shaft 19 of the secondary electric motor 18*a*.

The carrier element 21 in turn presents an outer surface to which a plurality of jaws 22 can be hingedly attached.

Three such jaws 22 are shown in the example of the drawings, equispaced advantageously at 120°, although the gripper could be equipped alternatively with a greater number of jaws, as dictated by the nature of the process and according to the structure and size of the particular cap 3.

The jaws 22 are hinged to the carrier element 21 and pivotable thus about respective axes transverse to the secondary axis 17*a*, between a position drawn toward one another, corresponding to the closed condition of the gripper 20, and a position spread apart from one another corresponding to the open condition of the gripper 20.

In particular, each jaw 22 appears as an elongated and curved plate presenting a first end 22*a*, a second end 22*b* remote from the first, and an intermediate portion 22*c* located between the first end 22*a* and the second end 22*b*.

As illustrated in the accompanying drawings, the intermediate portion 22*c* is located advantageously to coincide with a recessed portion of the jaw 22.

Moreover, the intermediate portion 22*c* is attached to the carrier element 21 by way of an anchor pivot neither described nor illustrated, being familiar in embodiment, on which the respective jaw 22 is able to rock back and forth.

The first end 22*a* carries a following roller 23 associated rotatably with the jaw 22 and presenting an outer surface that projects beyond the dimensional compass of the selfsame jaw.

The second end 22*b* of the jaw 22 presents a contact element 24 contoured advantageously to match a lateral portion of the cap 3 and combining with those of the other jaws 22 associated with the carrier element 21 to grip the cap 3 in readiness for the screwing step.

The gripping mechanism 17 further comprises an actuator 25, advantageously of linear type, by which the gripper 20 is caused to alternate between the open condition and the closed condition.

In a preferred embodiment, the linear actuator 25 will consist in a vertically reciprocating electric or pneumatic piston 26 associated with a mounting frame 27.

Figure 4:
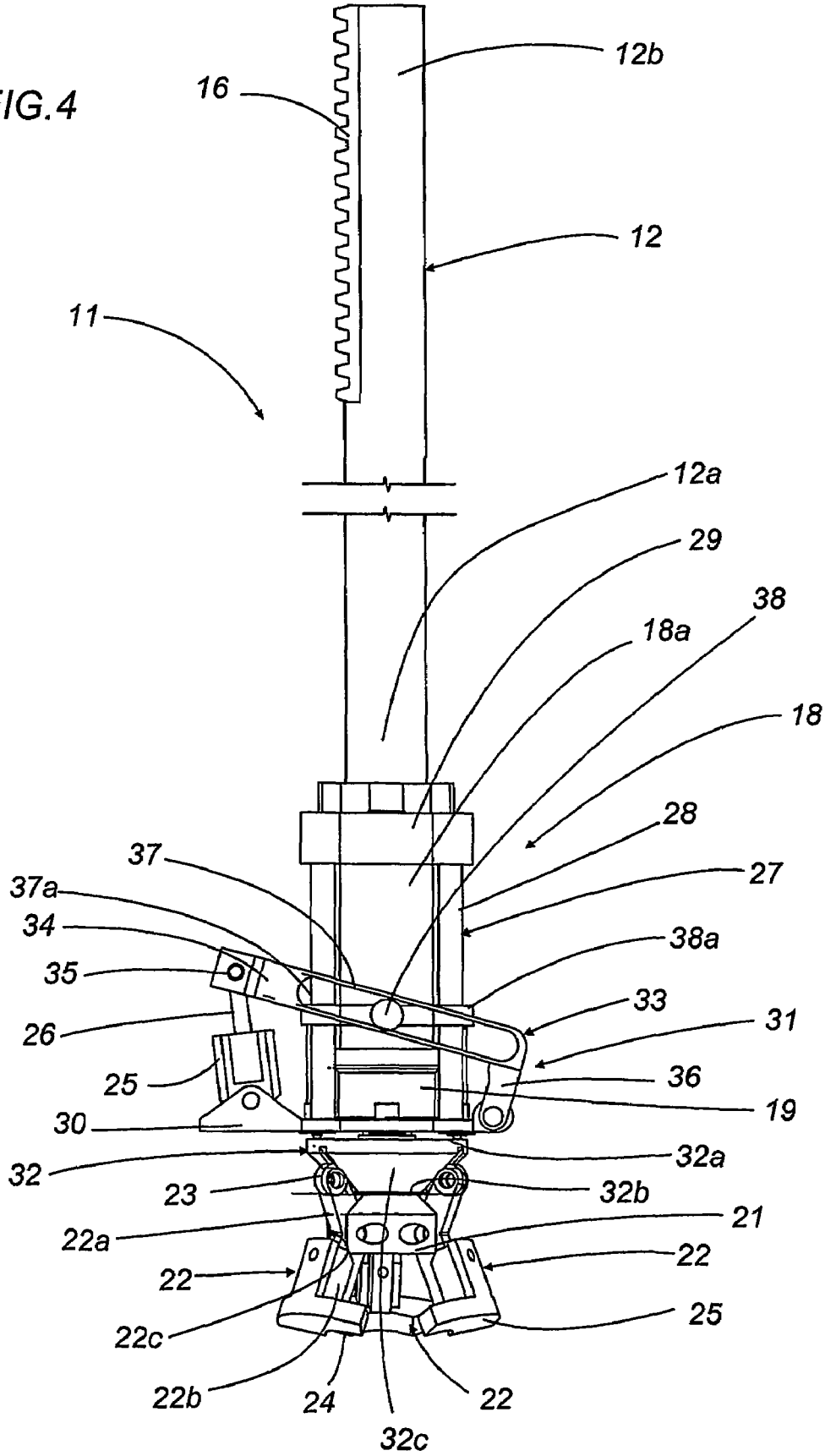
FIG. 4 is an elevation view showing a detail of the capping unit in a respective first operating condition.
Figure 5:
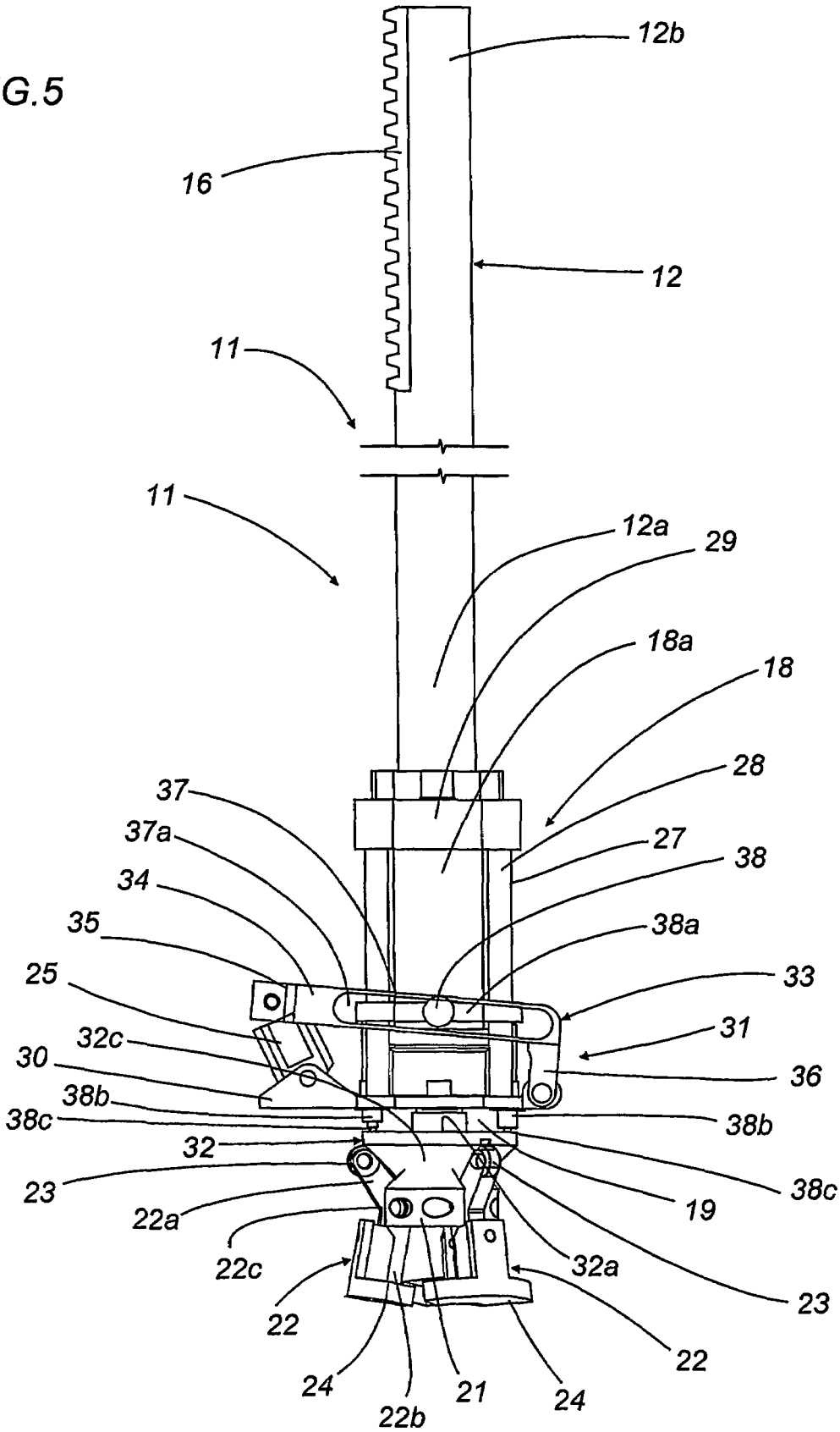
FIG. 5 is an elevation view showing the detail of FIG. 4 in a respective second operating condition.

In greater detail, as illustrated to advantage in FIGS. 4 and 5, the secondary electric motor 18*a* is locked to the rod 12 preferably by way of the aforementioned frame 27.

The frame 27 consists to advantage in four upright members 28 flanking the secondary motor 18*a* and extending parallel to the secondary axis 17*a*. The top ends of the four uprights 28 are connected to a coupling 29 by way of which the first end 12*a* of the rod 12 and the secondary motor 18*a* are rigidly associated.

The bottom ends of the uprights 28 are connected to a plate 30 disposed transversely to the secondary axis 17*a*, which preferably will afford a hole serving to admit the shaft 19 carrying the gripper 20.

This same plate 30 will also carry the linear actuator 25, which is positioned externally of the frame 27 so as to allow the reciprocating movement of the piston 26.

Also associated with the gripping mechanism 17 is a transmission component 31 interposed between the gripper 20 and the actuator 25, by which the movement of the piston 26 is relayed to the jaws 22.

More exactly, the transmission component 31 is composed of a plunger 32, and a mechanical linkage 33 rigidly associated with the plunger 32.

In greater detail, the plunger 32 is substantially frustoconical in appearance and associated coaxially with the shaft 19 of the secondary motor 18*a*. Thus, the shaft 19 of the secondary motor 18*a* is inserted through and freely slidably within a clearance hole afforded by the plunger 32.

In addition, the plunger 32 is interposed between the secondary motor 18*a* and the gripper 20 and presents a top end 32*a* coupled to the plate 30, and a bottom end 32*b* offered to the carrier element 21. The top end 32*a* and the bottom end 32*b* are interconnected by a downwardly tapered outer surface 32*c* against which the following rollers 23 of the single jaws 22 are caused to roll.

Still referring to FIGS. 4 and 5, the roller 23 of each jaw 22 is designed to roll vertically against the outer surface 32*c* of the plunger 32. As a result of the rolling action, the jaw 22 is caused to rock on the aforementioned pivot between the respective open and closed positions.

The mechanical linkage 33 presents a lever 34 of essentially rectangular outline, associated with the aforementioned frame 27. More exactly, the lever 34 presents a first portion 35 at one end, hinged to the piston 26 of the actuator 25, and a second portion 36 at the opposite end, which is hinged to the plate 30. The first and second portions 35 and 36 are interconnected rigidly by two guide portions 37 positioned one on either side of the frame 27.

It will be seen also that each guide portion 37 presents an opening 37*a* extending longitudinally between the first and second portions 35 and 36 and accommodating a relative pin 38.

The pin 38 in question is mounted to a respective cross member 38*a* slidable vertically on the frame uprights 28. In particular, the cross member 38*a* presents vertical portions 38*b* positioned to coincide with the uprights 28 and fitted with following rollers 38*c* offered to the first end 32*a* of the plunger 32.

In this situation, the pin 38 serves as a fulcrum on which the guide portion 37 is able to pivot, as will be described in due course.

Figure 6:
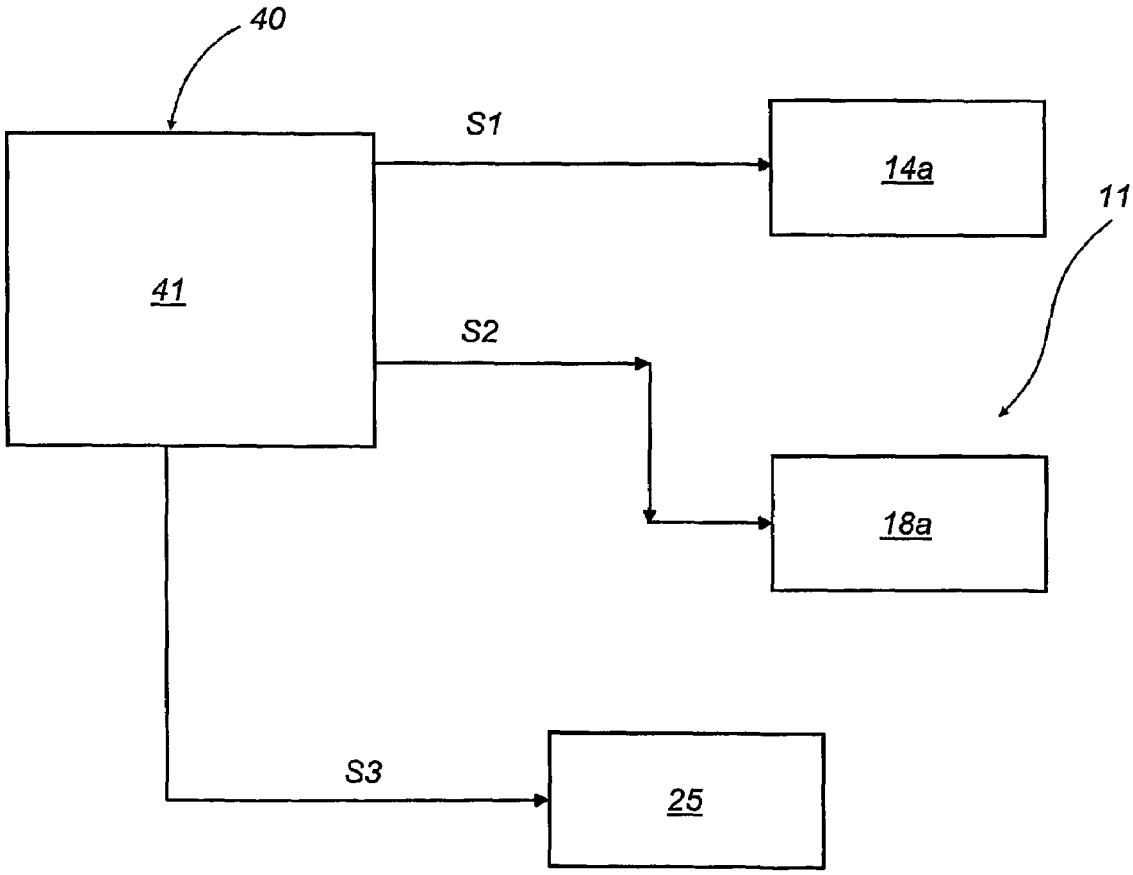
FIG. 6 is a block diagram of the capping unit.

The capping unit 1 further comprises an electronic controller 40 piloting the operation of each primary electric motor 14*a* and secondary electric motor 18*a*, as illustrated schematically in FIG. 6.

To advantage, the electronic controller 40 consists in an electronic processor of conventional type, which therefore is neither illustrated nor described in detail hereinafter.

The electronic controller 40 includes a processing block 41 serving to vary the operating parameters of the primary electric motor 14*a* and secondary electric motor 18*a* of each capping assembly 11.

More exactly, a signal S1 is sent by the processing block 41 to the primary electric motor 14*a* indicating the distance that must be covered by the rod 12 to reach the corresponding container 2. The signal S1 is processed according to the height of the container 2 and can differ from one capping assembly 11, hence one primary motor 14*a*, to another.

Similarly, a signal S2 is sent by the processing block 41 to the second electric motor 18*a*, indicating the moment at which the selfsame motor 18*a* will be activated. This second signal S2 is transmitted by the processing block 41 when the capping assembly 11 is in the relative second operating position.

To advantage, the processing block 41 is connected also to the linear actuator 25, to which it can send a third signal S3 indicating the moment when the piston 26 will be activated.

The operation of the unit 1, described thus far in predominantly structural terms, occurs in the following manner.

An ordered succession of containers 2 is directed onto the carrier component 5 by the rotary infeed conveyor 100, each with a respective cap 3 positioned on the neck 4. More precisely, each container 2 is located in a relative seat 9*b* of the base 9 with the neck 4 directed upwards.

As the carrier component 5 rotates, directing the containers 2 toward the rotary outfeed conveyor 105, signals S1, S2 and S3 are sent by the processing block 41 to each capping assembly 11. The signals in question are preset by an operator according to the operating specifications of the carrier component 5, and to the size of the containers 2.

Considering just one capping assembly 11 by way of example, a first signal S1 brings the primary electric motor 14*a* into operation, with the result that the corresponding gear 15*a* is caused to rotate and vertical motion induced in the rod 12.

The gripping mechanism 17 is thus moved into a position of close proximity to the cap 3 of the relative container 2 (corresponding to the second position of the capping assembly 11).

A signal S3 is now sent by the processing block 41 to the linear actuator 25, which will cause the gripper 20 to close around the cap 3. More exactly, the piston 26 strokes downwards, forcing the first end 35 of the lever 34 likewise downwards and the second end 36 of the lever 34 upwards.

Tilting thus on the pin 38, the lever 34 forces the cross member 38*a* down so that the respective vertical portions 38*b* impinge on the plunger 32, and this likewise is forced downwards.

As the plunger 32 shifts downwards, the roller 23 of each jaw 22 will roll on the outer surface 32*c* of the selfsame plunger 32 toward the first end 32*a*.

Consequently, the jaws 22 are constrained to rock on the relative intermediate portions 22*c* and drawn toward one another, with the result that the cap 3 is engaged by the contact elements 24 and gripped between the jaws 22.

Thereupon, a signal S2 is sent by the processing block 41 to the secondary electric motor 18*a*, which responds by rotating the relative shaft 19 in such a way as to screw the cap 3 onto the threaded neck 4 of the container 2 until a resisting torque registers and the motor 18*a* is prevented from turning further. At this point, the secondary electric motor 18*a* will be shut off by a relative automatic control function of conventional type, which is not described further. Following this deactivation step, a further signal S3 is sent by the processing block 41 to the linear actuator 25 to reopen the gripper 20.

More exactly, the piston 26 returns to its former position and the plunger 32 returns upward. As a result, the rollers 23 of the gripper jaws 22 roll toward the second end 32*b* of the plunger 32, causing the jaws 22 to rock on the pivots and spread.

Once the cap 3 has been released by the gripper 20, the processing block 41 causes the gear 15*a* to rotate in the opposite direction, raising the rod 12 and returning the capping assembly 11 to the first position.

With the cap 3 thus screwed onto the neck 4, the container 2 is directed ultimately by the carrier component 5 onto the rotary outfeed conveyor 105 which in turn directs the containers 2 through the second transfer station.

The problems associated with the prior art are addressed by the present invention and the stated objects duly realized.

First and foremost, it will be seen that each capping assembly 11 is equipped with respective first and second drive means 14 and 18 generating the movements needed to screw the cap 3 onto the container.

Consequently, the movements made by each capping assembly 11 can be adjusted independently, and the operation of the assembly thus adapted advantageously to the dimensions of the container 2. In other words, with independent regulation of the capping assemblies and the use of an electronic controller 40, it becomes possible to adjust and control the vertical movement of the rod 12, the rotation of the gripping mechanism 17 and the action of the gripper 20 both independently and on the basis of operating parameters selected according to the angular velocity of the carrier component 5, the physical properties of the container 2 and the cap 3, and the specified tightening torque.

Advantageously, the capping unit 1 is notably versatile in that it can be used with any type of container 2 and is easily programmed and adjusted by entering instructions via the processing block 41, which might be a conventional PLC, for example.

In addition, all dedicated appliances used for individual types of container are made redundant by the capping unit 1 disclosed, as also are the changes or modifications made to prior art appliances in order to enable their use with containers of different types.

The effect of reducing the number of appliances and change operations is to speed up the production cycle and lower the cost of the end product, as well as rendering the unit 1 itself more compact.

Moreover, the use of electronic systems in place of mechanical components brings the benefit of a reduced maintenance requirement in respect of such systems, and greater compactness of the components by which the capping assemblies 11 are set in motion.

The invention claimed is:

1. A capping unit for closing containers (2) with respective caps (3), comprising: a carrier and conveyor component (5) on which to advance the containers (2) and the respective caps (3); a motor (6) associated with the carrier and conveyor component (5), by which the carrier and conveyor component (5) is set in rotation about a respective primary axis (5*a*); a plurality of capping assemblies (11) associated with the carrier and conveyor component (5), each positioned above a corresponding container (2) and capable of movement vertically between a first position, distanced from the respective container (2), and a second position actively engaging the container, wherein each capping assembly (11) presents a gripping mechanism (17) such as can be associated with a relative cap (3) when the corresponding capping assembly (11) is in the second position, and the gripping mechanism (17) is rotatable in such a way as to screw the cap (3) onto a threaded neck (4) of the respective container (2) about a respective secondary axis (17*a*); first drive means (14) presenting a plurality of primary electric motors (14*a*), each one of which associated with a respective capping assembly (11) by which the single capping assemblies (11) can be set in motion vertically, one independently of another; second drive means (18) presenting a plurality of secondary electric motors (18*a*), each one of which associated with a respective gripping mechanism (17) by which the single gripping mechanisms (17) can be set in rotation one independently of another; and an electronic controller device (40) connected to each of the primary electric motors (14*a*) and the secondary electric motors (18*a*); wherein the electronic controller device comprises a processing block (41) by means of which to vary the operating parameters of each primary electric motor (14*a*) and each secondary electric motor (18*a*) according to the dimensions of the respective containers (2).

2. A unit as in claim 1, wherein the carrier and conveyor component (5) comprises:

a drum (8) associated with the motor (6) and rotatable about the primary axis (5*a*);

a base (9) associated with the bottom of the drum (8), on which to stand the containers (2);

a platform (10), associated with the top of the drum (8) and facing the base (9), to which the capping assemblies (11) are mounted in a circumferential formation.

3. A unit as in claim 2, wherein each capping assembly (11) comprises a rod (12) inserted slidably through a relative guide (13) afforded by the platform (10), extending longitudinally in coaxial alignment with the secondary axis (17*a*) and presenting a first end (12*a*) with which the respective gripping mechanism (17) is associated, and a second end (12*b*) opposite to the first end (12*a*).

4. A unit as in claim 3, wherein each secondary electric motor (18*a*) is mounted between the first end (12*a*) of the corresponding rod (12) and the gripping mechanism (17) and presents a shaft (19) rotatable about an axis parallel to the secondary axis (17*a*).

5. A unit as in claim 3, wherein each primary electric motor (14*a*) occupies a position coinciding with the second end (12*b*) of the rod (12) and above the platform (10).

6. A unit as in claim 5, wherein each secondary electric motor (18*a*) is mounted between the first end (12*a*) of the corresponding rod (12) and the gripping mechanism (17) and presents a shaft (19) rotatable about an axis parallel to the secondary axis (17*a*).

7. A unit as in claim 5, wherein each primary electric motor (14*a*) comprises a shaft (15) rotatable about a respective axis perpendicular to the secondary axis (17*a*), and a gear (15*a*) keyed to the shaft (15).

8. A unit as in claim 7, wherein each secondary electric motor (18*a*) is mounted between the first end (12*a*) of the corresponding rod (12) and the gripping mechanism (17) and presents a shaft (19) rotatable about an axis parallel to the secondary axis (17*a*).

9. A unit as in claim 7, wherein each rod (12) presents a rack (16) extending longitudinally along the respective second end (12*b*) and engaged in meshing contact by the gear (15*a*) of each primary electric motor (14*a*), in such a way that the rod (12) can be set in motion vertically by rotation of the gear (15*a*).

10. A unit as in claim 9, wherein each secondary electric motor (18*a*) is mounted between the first end (12*a*) of the corresponding rod (12) and the gripping mechanism (17) and presents a shaft (19) rotatable about an axis parallel to the secondary axis (17*a*).

11. A unit as in claim 10, wherein the gripping mechanism (17) comprises:

a gripper (20) attached to the shaft (19) of the respective secondary electric motor (18*a*), capable of movement between an open condition in which the relative capping assembly (11) is in the first position and a closed condition in which the relative capping assembly (11) is in the second position with the gripper (20) engaging the relative cap (3);

an actuator (25) by which the gripper (20) is caused to alternate between the open and closed conditions;

a transmission component (31) interposed between the gripper (20) and the actuator (25), by which motion is relayed from the actuator (25) to the gripper (20).

12. A unit as in claim 11, wherein the gripper (20) comprises:

a carrier element (21) of substantially cylindrical appearance, associated coaxially with the shaft (19) of the secondary electric motor (18*a*);

a plurality of jaws (22) hinged circumferentially to the cylindrical carrier element (21) and capable of movement between a position drawn toward one another, corresponding to the closed condition of the gripper (20), and a position spread apart from one another, corresponding to the open condition of the gripper (20).

13. A unit as in claim 12, wherein each jaw (22) presents a substantially curved appearance and is identifiable as having a first end (22*a*) furnished with a following roller (23), a second end (22*b*) opposite to the first end (22*a*), furnished with a contact element (24) designed to engage the cap (3), and an intermediate portion (22*c*) disposed between the first end (22*a*) and the second end (22*b*) and hinged to carrier element (21).

14. A unit as in claim 11, wherein each transmission component (31) comprises a plunger (32) of substantially frustoconical geometry coaxially encircling and slidable along the shaft (19) of the secondary electric motor (18*a*), and a mechanical linkage (33) coupled rigidly to the plunger (32).

15. A unit as in claim 14, wherein the plunger (32) presents a downwardly tapering outer surface (32*c*), and the following roller (23) of each jaw (22) rolls vertically on the downwardly tapering outer surface (32*c*).

16. A unit as in claim 14, wherein the actuator (25) is a linear actuator coupled to the mechanical linkage (33) in such a way as to induce a vertical movement of the plunger (32).

* * * * *